US009171682B2

(12) United States Patent
Sugihara et al.

(10) Patent No.: US 9,171,682 B2
(45) Date of Patent: Oct. 27, 2015

(54) OPERATION SWITCH

(71) Applicant: OMRON CORPORATION, Kyoto-shi, Kyoto (JP)

(72) Inventors: Masaki Sugihara, Izumo (JP); Hiroshi Tsugawa, Okayama (JP); Hiroyuki Moriyama, Okayama (JP)

(73) Assignee: OMRON Corporation, Kyoto (JP)

( * ) Notice: Subject to any disclaimer, the term of this patent is extended or adjusted under 35 U.S.C. 154(b) by 60 days.

(21) Appl. No.: 13/750,434

(22) Filed: Jan. 25, 2013

(65) Prior Publication Data

US 2013/0199907 A1 Aug. 8, 2013

(30) Foreign Application Priority Data

Jan. 31, 2012 (JP) ..... 2012-018625

(51) Int. Cl.

| | |
|---|---|
| ***H01H 9/00*** | (2006.01) |
| ***H01H 13/00*** | (2006.01) |
| ***H01H 19/04*** | (2006.01) |
| ***H01H 19/08*** | (2006.01) |
| ***H01H 9/02*** | (2006.01) |
| ***H01H 9/22*** | (2006.01) |
| ***H01H 13/04*** | (2006.01) |
| ***H01H 13/10*** | (2006.01) |

(52) U.S. Cl.

CPC ..... *H01H 9/02* (2013.01); *H01H 9/0207* (2013.01); *H01H 9/223* (2013.01); *H01H 13/04* (2013.01); *H01H 13/10* (2013.01)

(58) Field of Classification Search

CPC ..... H01H 9/00; H01H 13/00; H01H 19/04; H01H 19/08; H01H 3/04; H01H 3/12; H01H 13/04; H01H 2003/00; H01H 2009/00; H01H 2223/00; H01H 2223/002; H01H 2223/03; H01H 13/10

USPC ..... 200/296, 50.02, 43.07, 16 R, 341

See application file for complete search history.

(56) References Cited

U.S. PATENT DOCUMENTS

| | | | | |
|---|---|---|---|---|
| 5,178,504 | A * | 1/1993 | Falchi | 411/553 |
| 2007/0051608 | A1 * | 3/2007 | Pedersen et al. | 200/341 |

FOREIGN PATENT DOCUMENTS

| | | |
|---|---|---|
| CN | 201017792 Y | 2/2008 |
| DE | 10047998 | 3/2001 |
| EP | 2141715 | 1/2010 |
| JP | 2004-220827 A | 8/2004 |
| WO | WO 2011/032817 | 3/2011 |

* cited by examiner

*Primary Examiner* — Edwin A. Leon
*Assistant Examiner* — Anthony R. Jimenez
(74) *Attorney, Agent, or Firm* — Klarquist Sparkman, LLP

(57) ABSTRACT

An operation switch where a switch unit can be separated from an operation unit in a simple manner even when the operation switches are densely fitted is disclosed herein. The operation switch of the invention includes an operation unit that is disposed on a front surface side of a panel and operated by external pressing force, a switch unit that can be separated from a rear surface side of the panel from the operation unit, a latching unit formed on an external circumferential surface of the operation unit along an axial center direction, a latching receiving unit which is formed along an external circumferential surface of the switch unit and to which the latching unit is latched, and a release lever that releases a latching state of the latching unit and the latching receiving unit so that the switch unit is separated from the operation unit.

12 Claims, 14 Drawing Sheets

OPERATION SWITCH

TECHNICAL FIELD

The present invention relates to an operation switch, and more particularly to an operation switch where a switch unit is attachable to and detachable from an operation unit.

RELATED ART

When separating a switch unit from an operation unit attached to a panel in the related art, for example, Japanese Laid-open Patent Publication No. 2004-220827 discloses an operation switch where the switch unit is rotated relative to the operation unit about a medial axis so as to be separated from the operation unit.

However, in the operation switch, when separating the switch unit from the operation unit, in order to rotate the switch unit, it is necessary to hold the switch unit with fingers. For this reason, when the operation switches are densely fitted in a panel, the interval between adjacent operation switches is narrow, which might not allow a worker's finger to enter, resulting in a problem that it is difficult to rotate the operation unit for separation.

SUMMARY

The present invention is made in view of the above-mentioned problem, and is intended to provide an operation switch where a switch unit can be separated from an operation unit in a simple manner even though the operation switches are densely fitted.

In accordance with one aspect of the invention, there is provided an operation switch including an operation unit disposed on a front surface side of a panel and operated by external pressing force, a switch unit being attachable to and detachable from the operation unit from a rear surface side of the panel, a latching unit formed on an external circumferential surface of the operation unit along an axial center direction, a latching receiving unit which is formed along an external circumferential surface of the switch unit and to which the latching unit is latched, and a release lever that releases a latching state of the latching unit and the latching receiving unit so that the switch unit is separated from the operation unit, the release lever being configured to be operated from an external end portion of the switch unit.

According to the present invention, even though operation switches are densely fitted in a panel, a switch unit can be easily separated from an operation unit by operating a release lever protruding from an external end portion of the switch unit.

As an embodiment, the release lever includes a to-be-pressed portion that is formed in a portion in such a manner as to protrude from the external end portion of the switch unit, a releasing surface that is formed in another portion opposite to the to-be-pressed portion in such a manner as to engage with the latching unit, and an elastic arm that is disposed between the to-be-pressed portion and the releasing surface to hold the release lever in such a manner that the release lever stays at the switch unit, in which when the to-be-pressed portion is pressed, the releasing surface turns about the elastic arm so that the latching unit may be displaced.

According to the present embodiment, when the to-be-pressed portion is pressed, because a releasing surface turns about the elastic arm to displace the latching unit, the latching state of the operation unit and the switch unit is released so that the operation unit and the switch unit can be separated.

As another embodiment, the latching unit is formed of a connection portion with a hole, the latching receiving unit is formed of a rib which protrudes outward from the switch unit. In the configuration, when an engaging surface of the rib is latched to the hole, the operation unit and the switch unit are latched to each other and the releasing surface presses and expands the connection portion.

As a further embodiment, the latching unit is formed of a rib which protrudes inward from the operation unit, and the latching receiving unit is formed of a hole. In the configuration, when an engaging surface of the rib is latched in to the hole, the operation unit and the switch unit are latched to each other and the releasing surface presses the rib so that the rib may expand.

As a yet further embodiment, the release lever integrally combines with the latching receiving unit, and includes a to-be-pressed portion that protrudes from an external form of the switch unit, the latching receiving unit formed on a portion opposite the to-be-pressed portion and configured to be latched to the latching unit, and an elastic arm that is disposed between the to-be-pressed portion and the latching receiving unit and that holds the release lever so that the release lever stays at the switch unit. In the configuration, when the to-be-pressed portion is pressed, the latching receiving unit turns about the elastic arm so as to be separated from the latching portion.

According to the present embodiment, when the to-be-pressed portion is pressed, the pressing force is more directly transferred to the latching receiving unit so that the latching receiving unit is separated from the latching unit. In this way, the latching between the operation unit and the switch unit can be surely released.

As a yet further embodiment, the to-be-pressed portion may protrude from an end surface of the switch unit in a detaching direction along which the switch unit is detached.

According to the present embodiment, although operation switches are densely arranged side by side, if space is available in the detaching direction of the switch unit, the to-be-pressed portion of the release lever may be easily pressed so that the operation unit can be surely separated from the switch unit.

The to-be-pressed portion may protrude from the external circumferential surface of the switch unit in a direction orthogonal to the detaching direction of the switch unit.

According to the present embodiment, although the operation switches are densely arranged, if space is available in the direction orthogonal to the detaching direction of the switch unit, the to-be-pressed portion of the release lever may be easily pressed so that the operation unit may be surely separated from the switch unit.

BRIEF DESCRIPTION OF THE DRAWING(S)

DESCRIPTION OF EMBODIMENT

An embodiment of an operation switch 10 according to the invention is described with reference to FIGS. 1A to 14.

Figure 1A:
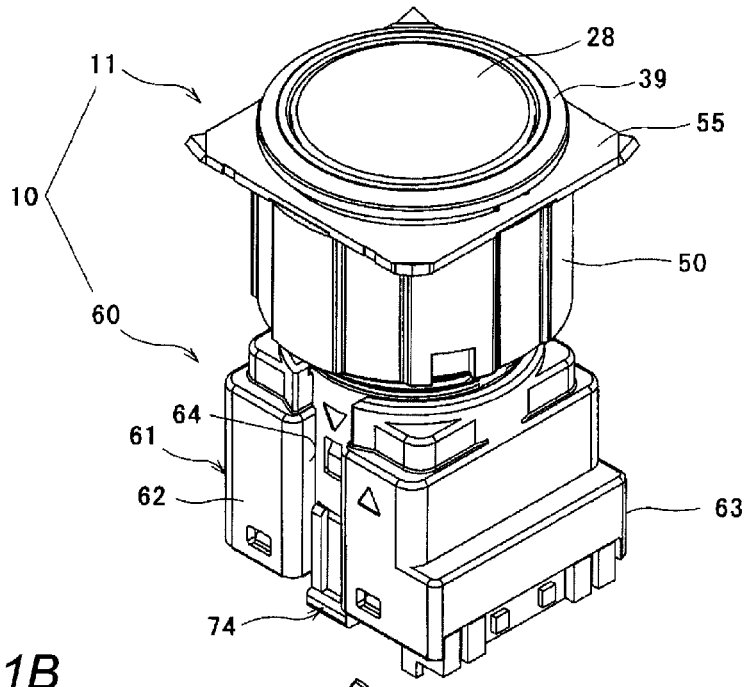
FIG. 1A is a perspective view of an operation switch according to a first embodiment viewed from above.
Figure 1B:
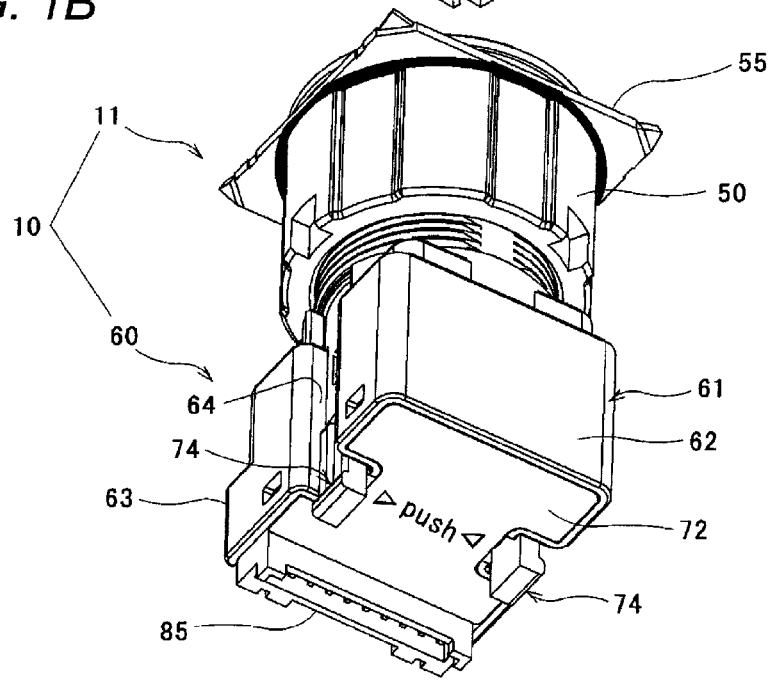
FIG. 1B is a perspective view of the operation switch of FIG. 1A viewed from below.
Figure 2:
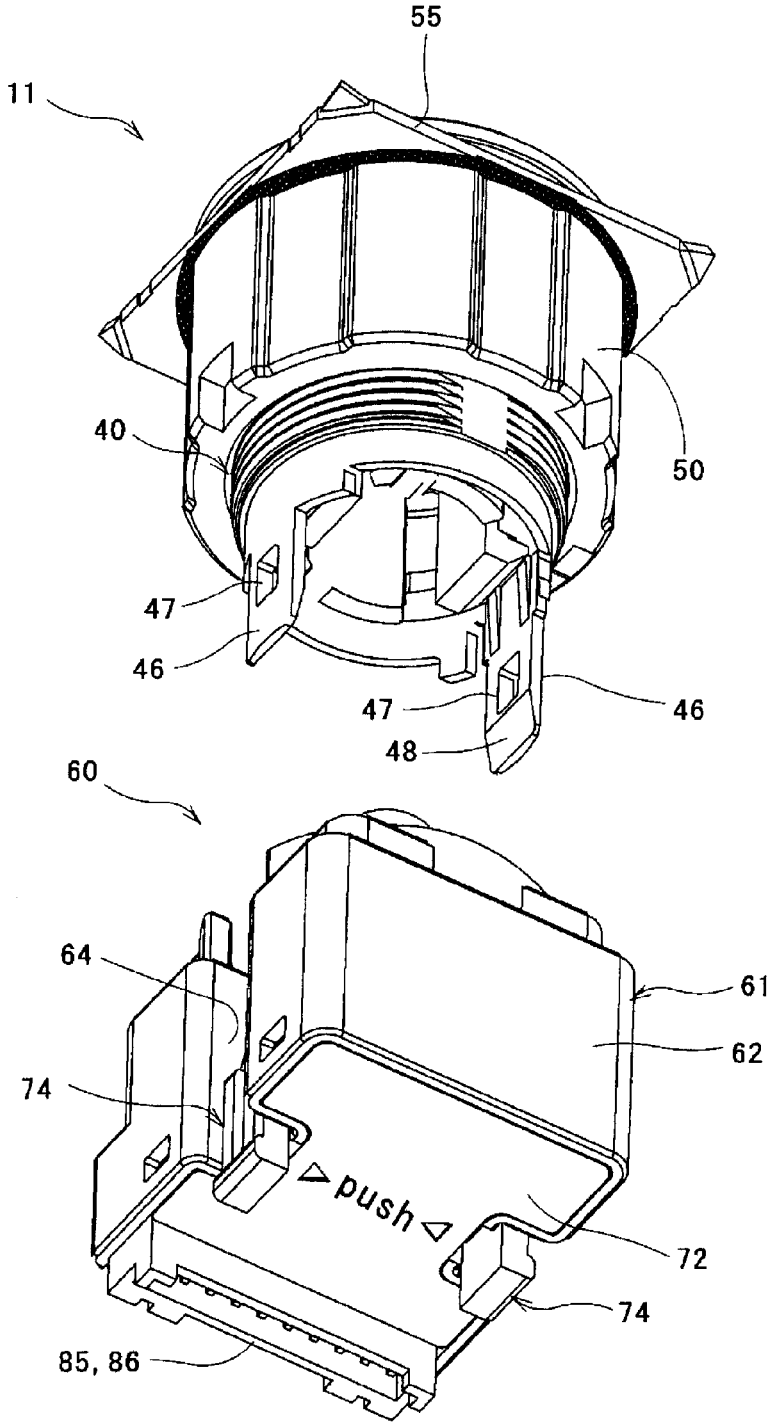
FIG. 2 is an exploded perspective view illustrating a state where the operation switch of FIG. 1A is separated into an operation unit and a switch unit.

As illustrated in FIGS. 1A to 2, the operation switch 10 according to a first embodiment includes an operation unit 11 which is externally pressed by a user for operation, and a switch unit 60 which has a built-in switch 81 (refer to FIG. 4) which is switched on or off according to the operation.

Figure 3:
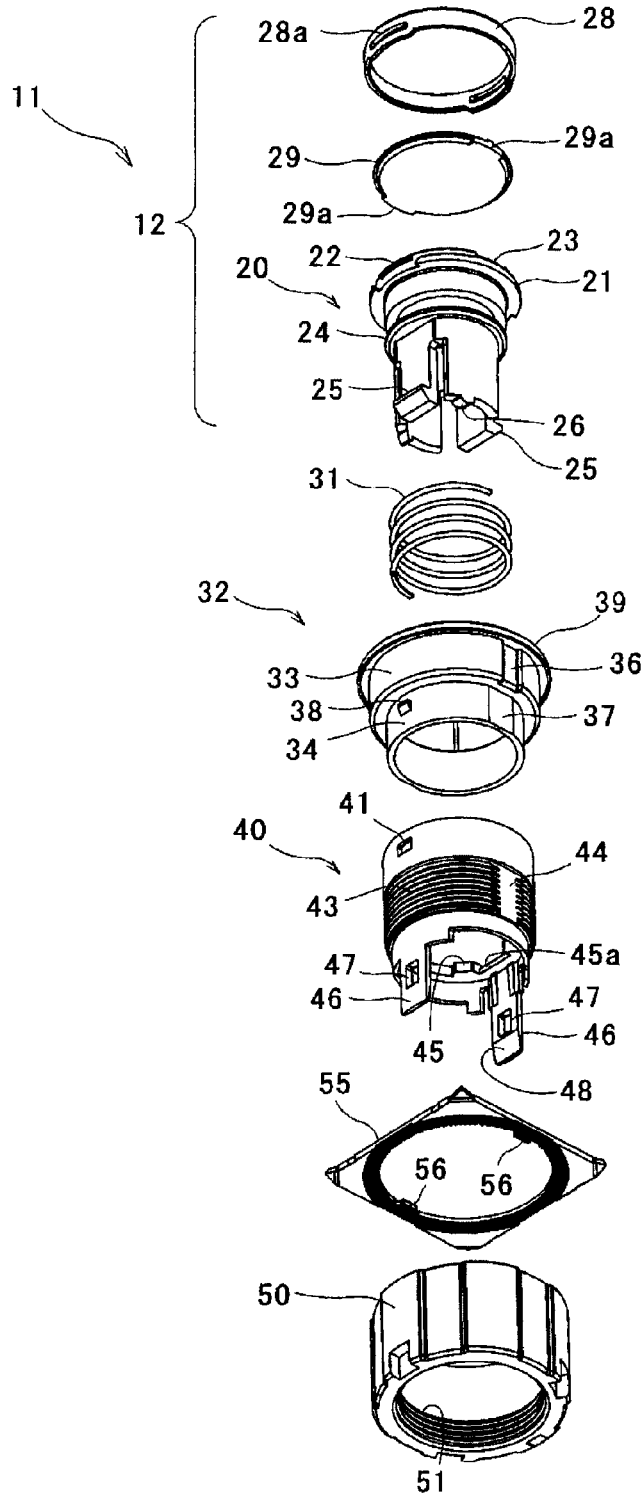
FIG. 3 is an exploded perspective view of the operation unit of FIG. 2.

As illustrated in FIG. 3, the operation unit 11 includes a movable unit 12 which moves up and down by pressing force given by the user, a screw-thread fitting unit 40 which has the movable unit 12 inside thereof, and a ring fitting unit 50 which fastens the screw-thread fitting unit 40 to a panel 15 or the like.

The movable unit 12 includes a cylindrical plunger operation unit 20, a circular cap 28 that covers an upper end opening of the plunger operation unit 20, and a circular diffuser plate 29 that is interposed between the plunger operation unit 20 and the cap 28. An upper end edge portion 21 of the plunger operation unit 20 is provided with a pair of cap tongues 22 that protrude outward in a radial direction, and a pair of diffuser plate notches 23 that are notched in a downward direction. In addition, an annular protrusion 24 extending in the circumferential direction is provided under the upper end edge portion 21. A lower end of the plunger operation unit 20 is provided with a pair of claws 25 that protrude outward in the radial direction and an operation rib 26 that protrudes downward. A side surface of the cap 28 is provided with long holes 28*a* to engage with the cap tongues 22. An external circumferential portion of the diffuser plate 29 is provided with a latching rib 29*a* which is latched to the diffuser plate notches 23 of the plunger operation unit 20.

The movable unit 12 is attached to the screw-thread fitting unit 40 via a return spring 31 and a flange 32. An upper end of the return spring 31 abuts on the annular protrusion 24 of the plunger operation unit 20. The flange 32 has a cylindrical shape, and includes an upper flange 33 of a larger diameter, and a lower flange 34 of a smaller diameter. An external circumferential surface of a wall of the upper flange 33 is provided with an upper groove 36 which extends in a vertical direction. An external circumferential surface of a sidewall of the lower flange 34 is provided with a lower groove 37 which extends in the vertical direction, and a latching protrusion 38 which protrudes outward in a radial direction.

The screw-thread fitting unit 40 has a cylindrical shape, and is provided with a rectangular hole 41, a male screw 43, and a connection portion 46, which are arranged in this order from the top, in the external circumferential surface. The rectangular hole 41 engages with the latching protrusion 38, and the male screw 43 is screwed with the ring fitting unit 50. A planar portion 44 which extends in the vertical direction is formed in a portion of the male screws 43. The connection portion 46 is a pair of plate-shaped members extending downward, and is provided with a connection hole 47 connected with the switch unit 60. In addition, a connecting inclined surface 48 is formed in a distal end portion of the connection portion 46 where the thickness decreases toward the edge.

An annular rib 45 protruding inward in the radial direction is formed on an internal circumferential surface of the screw-thread fitting unit 40, and the annular rib 45 is provided with anti-slipping notches 45*a*. A lower end of the return spring 31 abuts on an upper surface of the annular rib 45. The plunger operation unit 20 is prevented from slipping off the screw-thread fitting unit 40 when the anti-slipping notches 45*a* engage with the claws 25 of the plunger operation unit 20.

The ring fitting unit 50 has a cylindrical shape, and has an internal circumferential surface in which a female screw 51 to be screwed with the mail screw 43 of the screw-thread fitting part 40 is engraved. The female screw 51 is screwed with the male screw 43 so that the ring fitting unit 50 may approach the upper end edge portion 39 of the flange 32 via an irrotational fitting 55. The irrotational fitting 55 is a rectangular plate with the inside which is cut away in an approximate circular form. A pair of latching tongues 56 that protrude inward in the radial direction is provided in an internal circumferential surface of the irrotational fitting 55.

Figure 4:
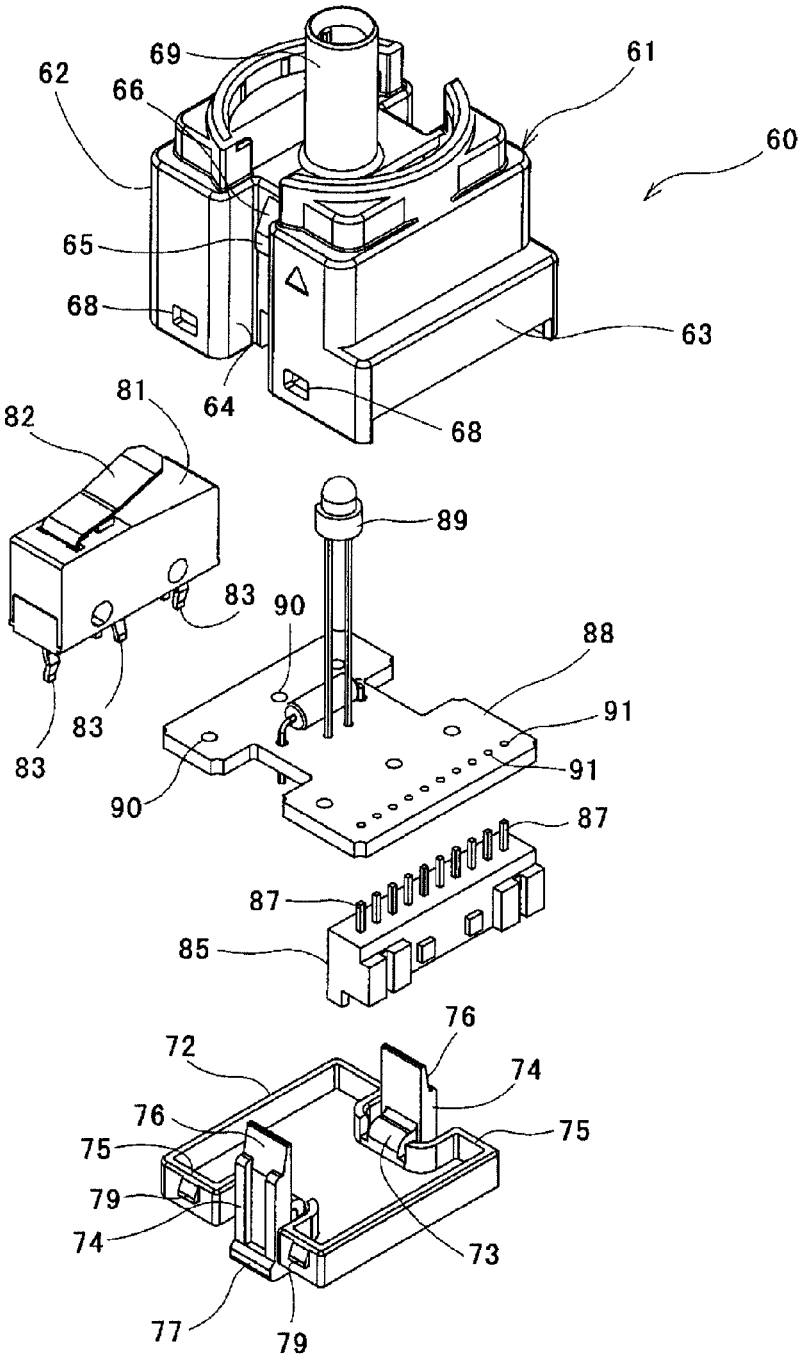
FIG. 4 is an exploded perspective view of the switch of FIG. 2 viewed from above.
Figure 5:
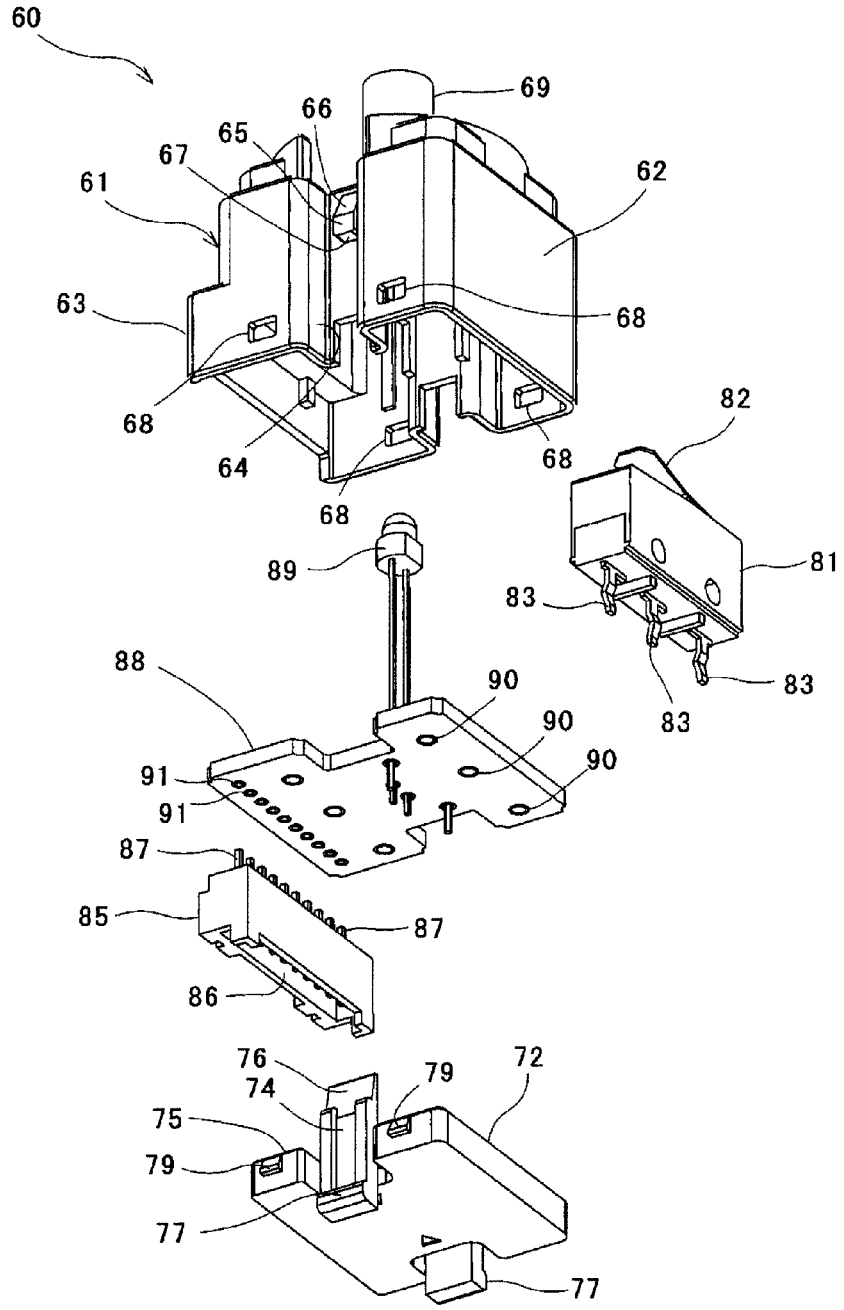
FIG. 5 is an exploded perspective view of the switch of FIG. 2 viewed from below.

As illustrated in FIGS. 4 and 5, the switch unit 60 is provided with a switch cover 61 connected with the operation unit 11, and a cover body 72 which covers a bottom opening of the switch cover 61.

A built-in switch 81 which is switched on or off by interlocking with operation of the operation unit 11, a connector 85 connected to an external terminal (not shown), and a substrate 88 that connects the built-in switch 81 and the connector 85 to each other are provided in the switch cover 61. The built-in switch 81 includes an interlocking fitting 82 operated by the operation rib 26 of the plunger operation unit 20, and a fixed contact terminal 83 which protrudes from a surface which is opposite the interlocking fitting 82. The connector 85 includes a terminal connection portion 86 to be connected to an external terminal (not shown), and a plurality of connector terminals 87 which protrude from a surface opposite to the terminal connection portion 86. The substrate 88 is an approximate H-shaped plate to which an LED 89 which emits light upward is connected. The fixed contact terminals 83 of the built-in switch 81 are connected to connection holes 90 arranged in a row on one side of the substrate 88 from above, and the connector terminals 87 of the connector 85 are connected to through-holes 91, which are arranged in a row on the other side of the substrate 88 which is opposite the connection holes 90, from below.

As illustrated in FIG. 5, the switch cover 61 includes a box-shaped switch body 62 which accommodates the built-in switch 81 therein, and a connector accommodation portion 63 which protrudes outward from a side surface of the switch body 62 and which accommodates the connector 85 therein. Each of both opposed side surfaces of the switch body 62 is provided with a guide groove 64 which extends in the vertical direction. A connection rib 65 to engage with the connection hole 47 of the screw-thread fitting unit 40 is provided above an upper portion of the guide groove 64. A guiding inclined surface 66 is formed at an upper end of the connection rib 65, and an engaging surface 67 which orthogonally rises from the guide groove 64 is formed at a lower end of the connection rib 65. A pair of cover installing holes 68 is formed at a lower portion of a side surface of the switch cover 61, with the guide groove 64 in between. In addition, an LED accommodation portion 69 of a cylindrical shape to accommodate the LED 89 therein is provided in such a manner as to protrude from an upper portion of the switch cover 61.

As illustrated in FIG. 4, the cover body 72, the plan view of which is substantially H-shaped, includes release levers 74 each of which integrally combines with a bottom surface of a recess of the cover body 72 via an elastic arm 73. An upper end of the release lever 74 is provided with a releasing surface 76 which decreases in thickness toward a distal end, and a lower end of the release lever 74 is provided with a to-be-pressed portion 77 which protrudes outward. The elastic arm 73 which curves toward the bottom of the cover body 72 is provided between the releasing surface 76 and the to-be-pressed portion 77. An upper end of the release lever 74 extends higher than a peripheral wall 75 of the cover body 72, and the to-be-pressed portion 77 protrudes downward from the bottom surface of the cover body 72. A pair of latching protrusions 79 is formed respectively in opposed peripheral walls 75 with release lever 74 in between. The latching protrusions 79 are latched to the installing holes 68, respectively.

Next, a method of assembling the operation switch 10 having the above-described configuration is described.

In order to assemble the operation unit 11, as illustrated in FIG. 3, the latching ribs 29*a* of the diffuser plate 29 are first made to engage with the diffuser plate notches 23 of the plunger operation unit 20. Next, the cap tongues 22 of the plunger operation unit 20 are fitted into the long holes 28*a* of the cap 28 to assemble the movable unit 12.

Next, the latching protrusion 38 of the flange 32 is made to engage with the rectangular hole 41 of the screw-thread fitting unit 40, and the flange 32 is fixed to the screw-thread fitting unit 40. Next, in a state in which the return spring 31 is latched to the upper surface of the annular rib 45 of the screw-thread fitting unit 40, the assembled movable unit 12 is inserted in the inside of the return spring 31, the flange 32, and the screw-thread fitting unit 40. Since the return spring 31 is pressed to contract between the upper surface of the annular rib 45 and the annular protrusion 24 of the plunger operation unit 20 at this time, the movable unit 12 is biased up by the elastic force of the return spring 31. Next, the claws 25 of the plunger operation unit 20 elastically deform to be latched to the anti-slipping notches 45*a* of the screw-thread fitting unit 40, preventing the movable unit 12 from slipping off the screw-thread fitting unit 40.

Figure 6B:
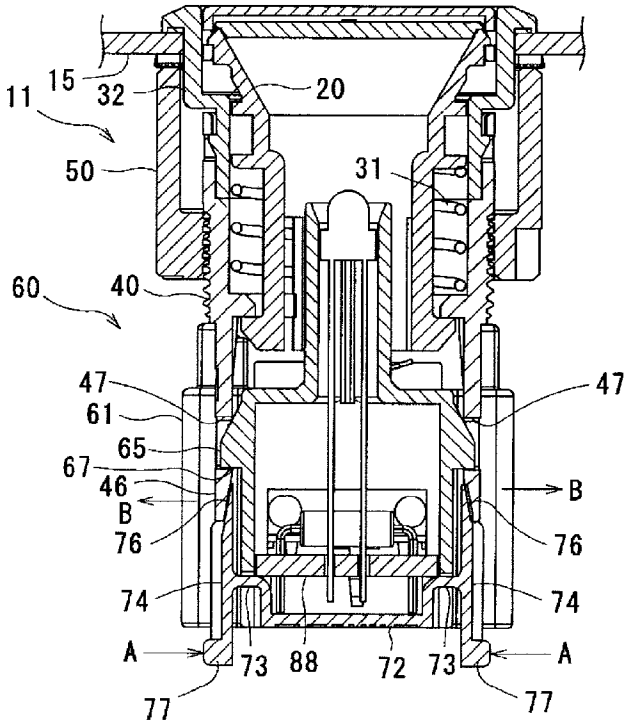
FIG. 6B is a sectional view illustrating a state where the switch unit is mounted to the operation unit.
Figure 6A:
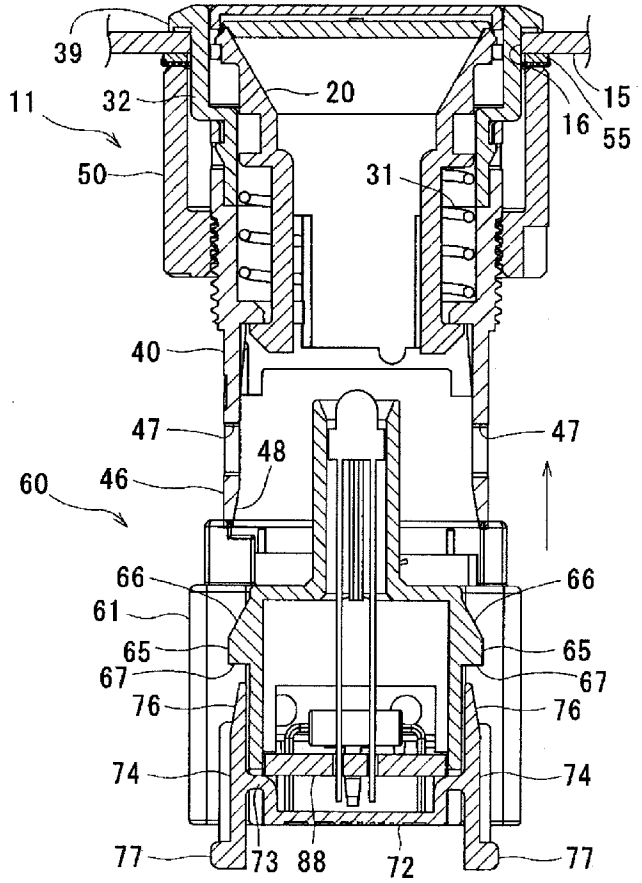
FIG. 6A is a sectional view illustrating a state where the operation unit and the switch part are separated.

Next, as illustrated in FIG. 6A, the flange 32 is inserted into a hole 16 of a panel 15 so that an upper edge of the hole 16 and an upper surface edge 39 of the flange 32 are brought into contact with each other. Next, the irrotational fitting 55 is externally inserted into the screw-thread fitting unit 40 from below and brought into contact with the panel 15 so that the latching tongues 56 may pass through the planar portion 44 of the male screw 43 and may be latched in the upper grooves 36. Because the latching tongues 56 are latched in the upper grooves 36, the irrotational fitting 55 is prevented from rotating. Next, the female screw 51 of the ring fitting unit 50 is screwed with the male screw 43 from below of the screw-thread fitting unit 40 so that the panel 15 is fastened tight between the upper end edge 39 of the flange 32 and the irrotational fitting 55. Thereby, installation of the operation unit 11 to the panel 15 is completed.

Next, in order to assemble the switch unit 60, the fixed contact terminals 83 of the built-in switch 81 are connected to the connection holes 90 of the substrate 88 from the upper side, and the connector terminals 87 of the connector 85 are inserted into the through-holes 91 of the substrate 88 from below. Next, the substrate 88 is put into the switch cover 61. Finally, the release lever 74 of the cover body 72 is guided into the guide hole 64 from below, and the latching protrusions 79 are latched to the cover installation holes 68. As a result, the cover body 72 is mounted to the switch cover 61 and the switch unit 60 is completely assembled.

Figure 7A:
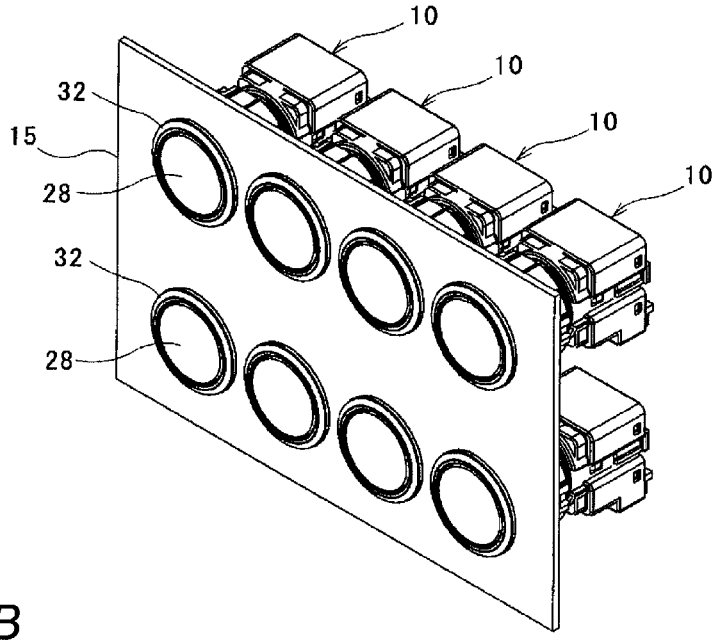
FIG. 7A is a perspective view illustrating a state where an operation switch is fixed to a panel which is viewed from the front side.
Figure 7B:
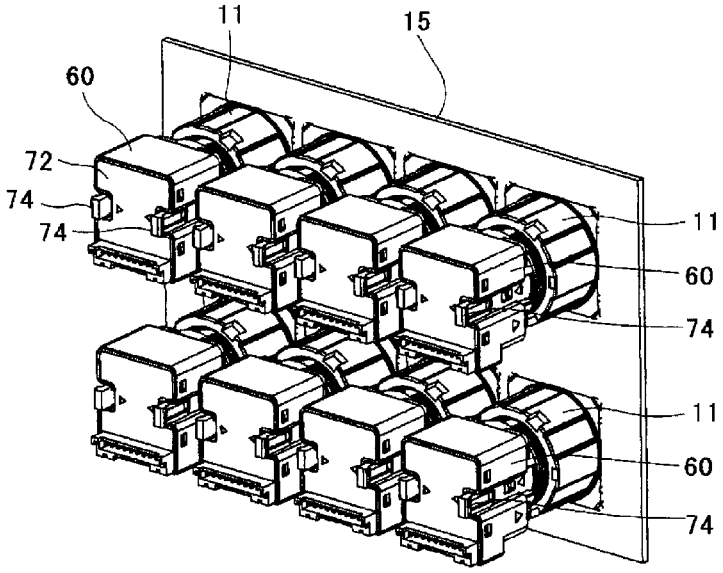
FIG. 7B is a perspective view illustrating the state of FIG. 7A viewed from the rear side.
Figure 8B:
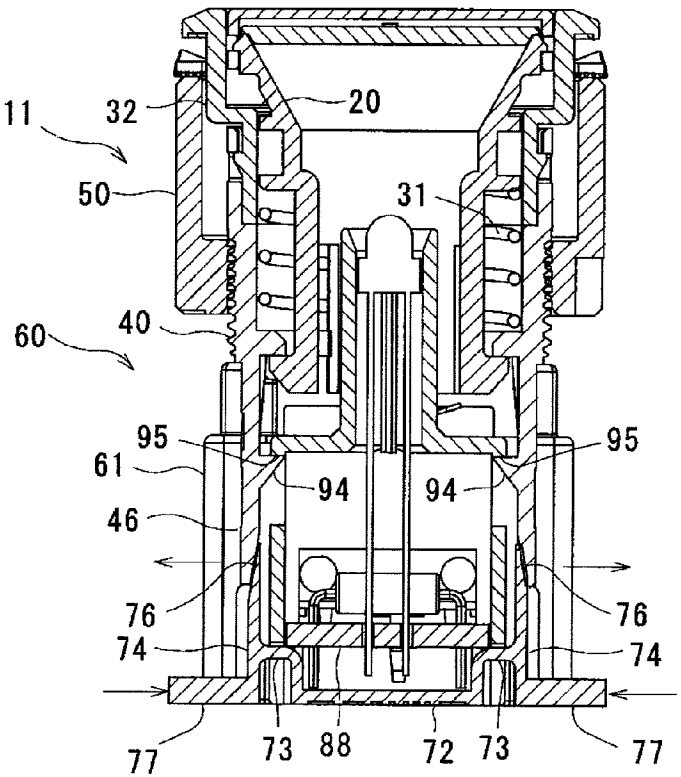
FIG. 8B is a sectional view according to a second modification of the first embodiment.
Figure 8A:
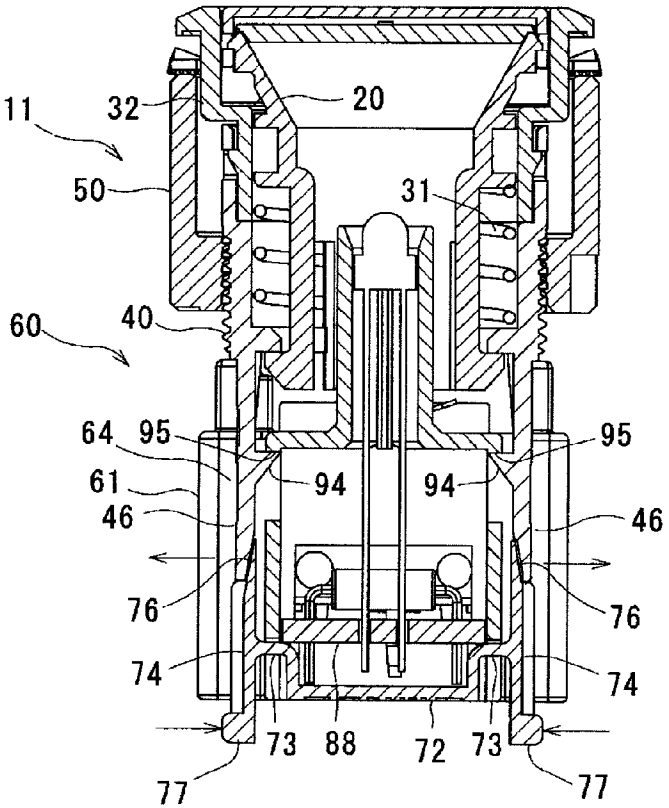
FIG. 8A is a sectional view according to a first modification of the first embodiment.
Figure 9A:
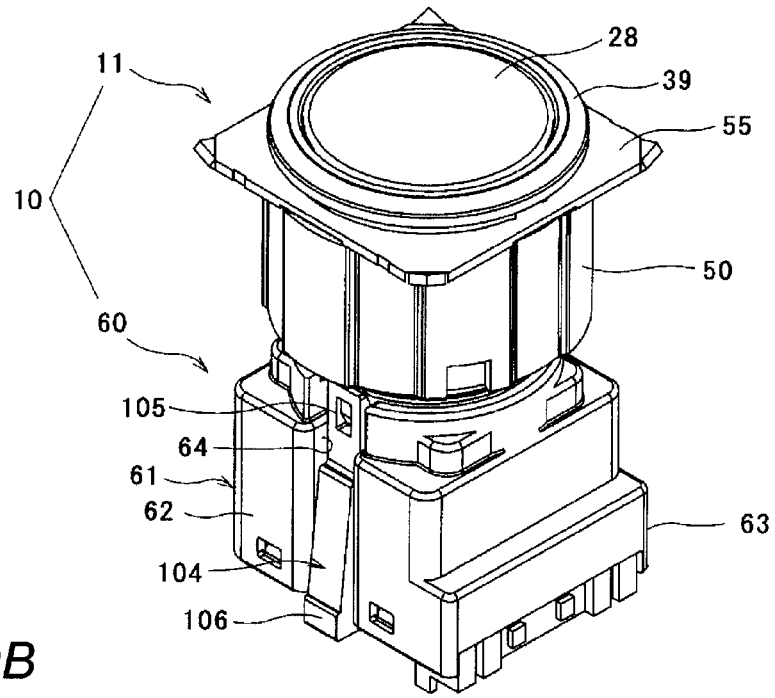
FIG. 9A is a perspective view of an operation switch according to the second embodiment viewed from above.
Figure 9B:
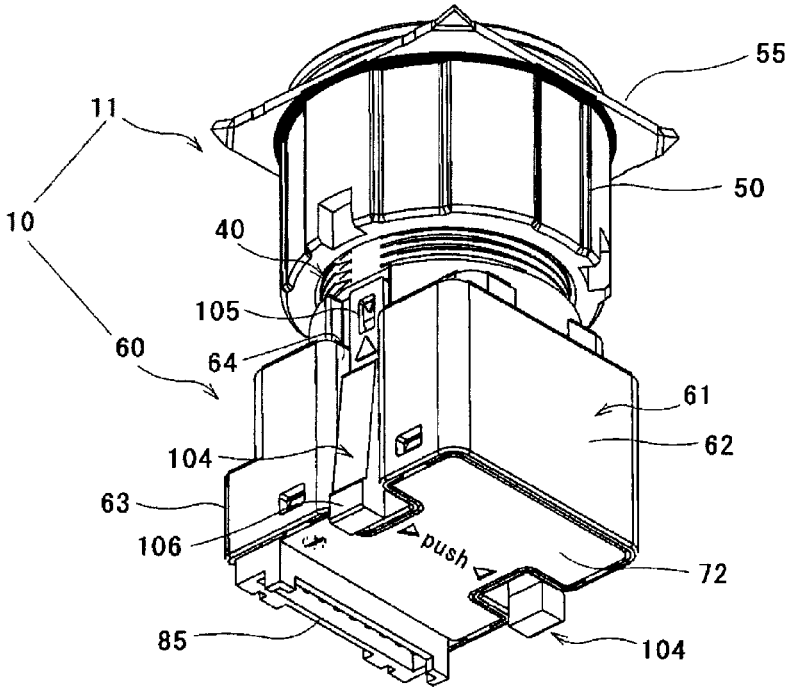
FIG. 9B is a perspective view of the operation switch of FIG. 9A viewed from below.
Figure 10:
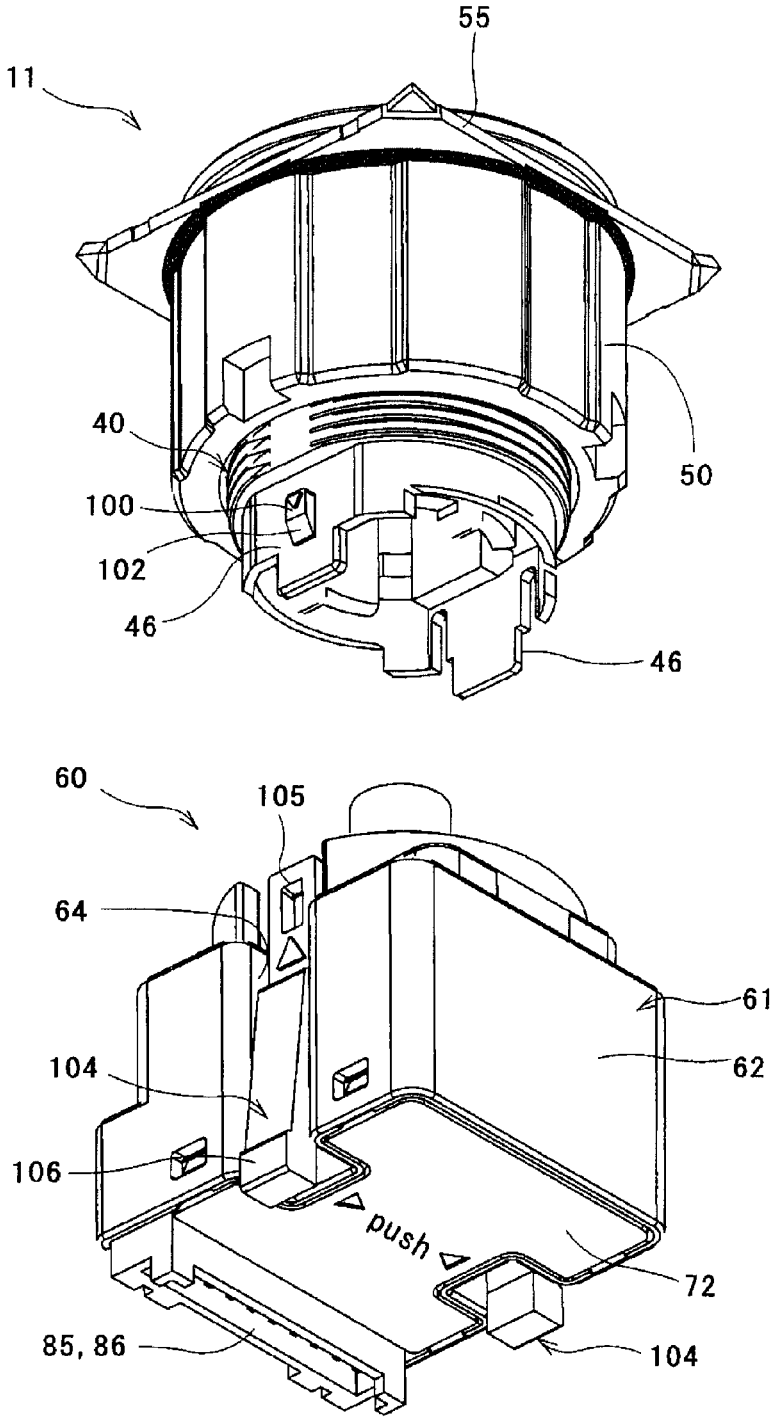
FIG. 10 is an exploded perspective view illustrating a state where the operation switch of FIG. 9 is separated into an operation unit and a switch unit.
Figure 11:
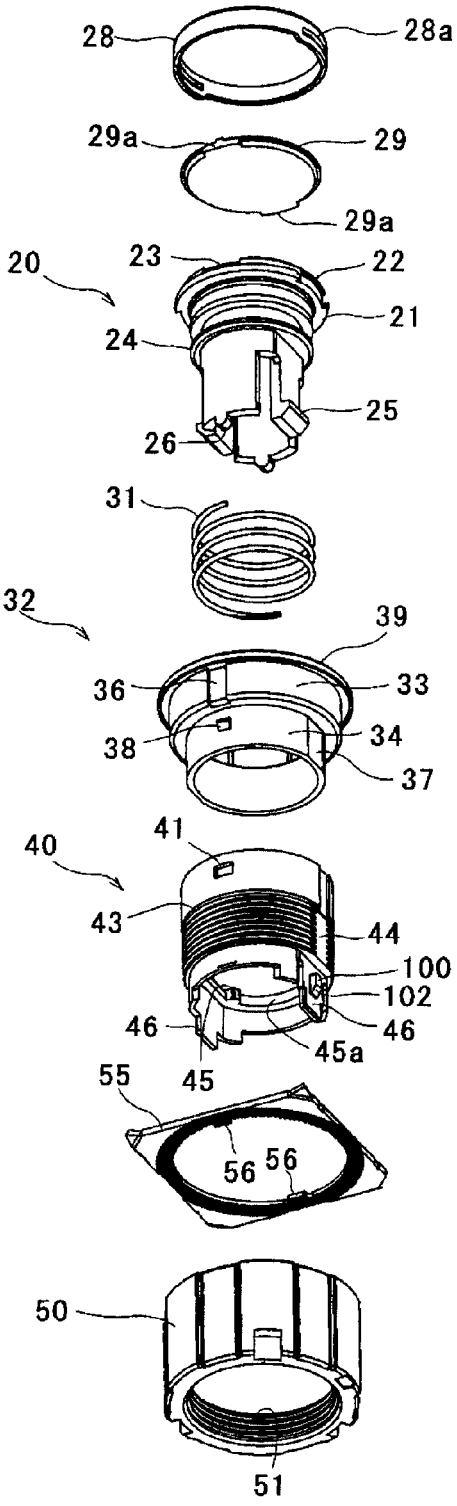
FIG. 11 is an exploded perspective view of the operation unit of FIG. 10.
Figure 12:
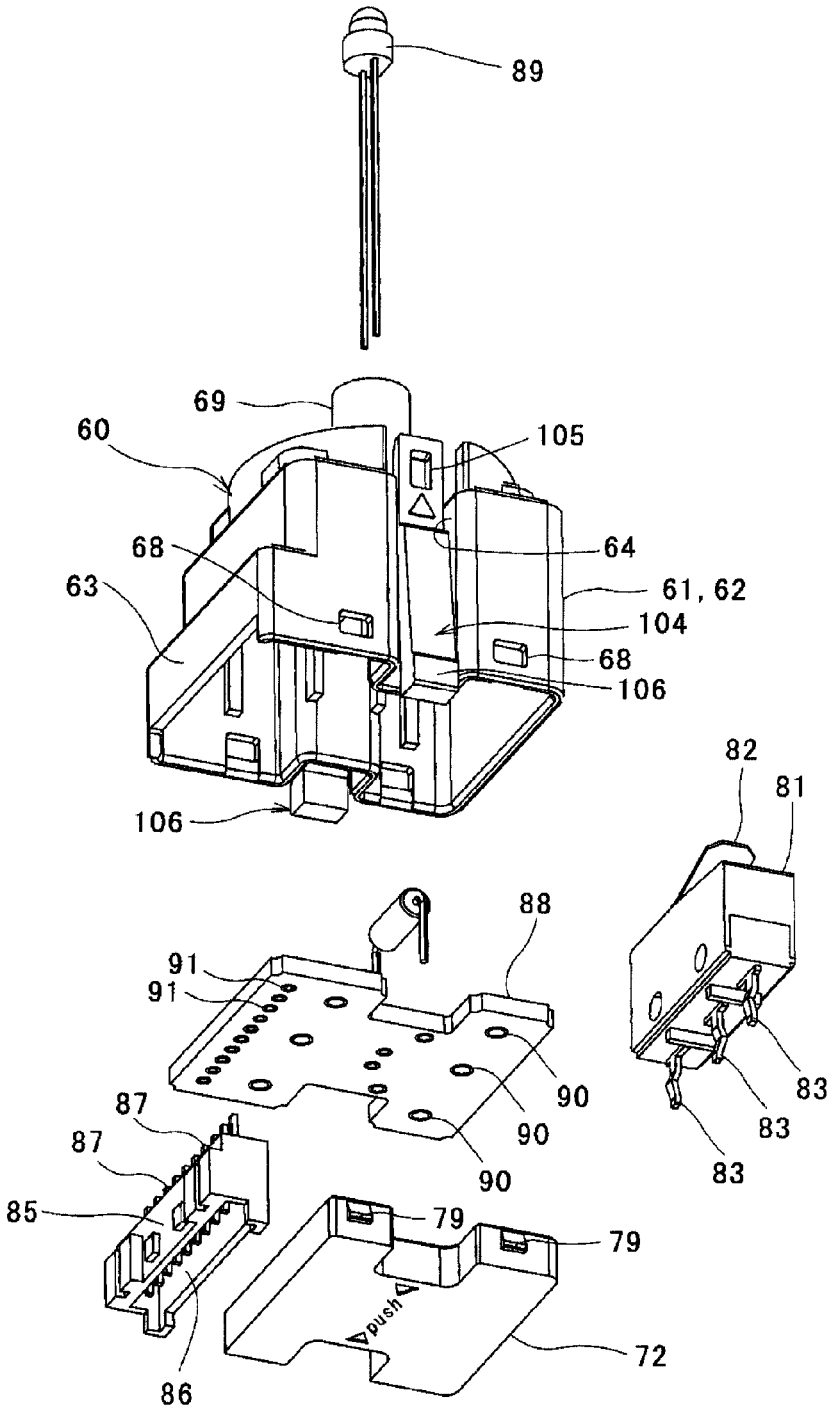
FIG. 12 is an exploded perspective view of the switch unit of FIG. 10.

Next, in order to connect the switch unit 60 to the operation unit 11, the guide groove 64 of the switch unit 60 is positioned at the connection portion 46 of the screw-thread fitting unit 40 attached to the panel 15, and the guiding inclined surface 66 is brought into sliding contact with the connecting inclined surface 48. Next, when the connection portions 46 are inserted into the guide grooves 64, the connection holes 47 pass over the connection ribs 65 and are then latched by the engaging surfaces 67. As a result, the connection holes 47 and the connection ribs 65 engage with each other, and attachment of the switch unit 60 to the operation unit 11 is completed. As illustrated in FIGS. 7A and 7B, by repeating this assembling operation, the operation switches 10 are densely fitted in the panel 15.

In order to separate the switch unit 60 from the operation unit 11, as indicated by arrow A of FIG. 6B, the to-be-pressed portion 77 of the release lever 74 is pressed inward. With this operation, the elastic arm 73 bends and the release lever 74 turns about a base portion of the elastic arm 73, so that the releasing surfaces 76 move outward as indicated by arrow B. By this, the connection portions 46 are pressed in the direction of the arrow B by the releasing surfaces 76, and the latching state of the connection holes 47 and the engaging surfaces 67 is released, so that the switch unit 60 can be separated from the operation unit 11. In this way, even though the operation switches 10 are densely fitted in the panel 15, when the release lever 74 of the switch unit 60 is operated from the external end portion of the switch unit 60, the switch unit 60 can be easily separated from the operation unit 11. Moreover, even though the operation switches 10 are densely fitted in the panel 15, if there is space in a pulling-out direction of the switch unit 60, the switch unit 60 can be separated from the operation unit 11 by operating the to-be-pressed portion 77 of the release lever 74.

The present invention is not limited to the first embodiment, but various modifications thereof are possible.

In the above-mentioned embodiment, although the connection portion 46 which has the connection hole 47 is provided in the screw-thread fitting unit 40, and the connection rib 65 is provided in the guide groove 64, the invention is not limited thereto. For example, like a first modification illustrated in FIG. 8A, in a case where a connection rib 94 which protrudes inward from a connection portion 46 of a screw-fitting unit 40 is provided and a connection hole 95 is provided in a guide groove 64, the same advantages can be obtained.

In addition, although the to-be-pressed portion 77 of the release lever 74 protrudes downward from a lower portion of the cover body 72 in the first embodiment, the invention is not limited thereto. For example, like a second modification illustrated in FIG. 8B, a configuration may be adopted in which a to-be-pressed portion 77 protrudes from a cover body 72 in a direction orthogonal to a detaching direction of a switch unit 60. With this configuration, even though operation switches 10 are densely fitted in a panel 15, if there is space in a direction orthogonal to the detaching direction of the switch unit 60, the switch unit 60 can be separated from the operation unit 11 by operating the to-be-pressed portion 77 of the release lever 74.

As illustrated in FIGS. 9A to 13B, a second embodiment provides a configuration in which a connection rib 100 is provided in such a manner as to protrude outward from a connection portion 46 provided at a lower end of a screw-thread fitting unit 40, and a release lever 104 is provided in a guide groove 64 of a switch cover 61. An engaging surface 101 that orthogonally rises from the connection portion 46 is formed at an upper end of the connection rib 100 (refer to FIG. 13A). A guiding inclined surface 102 is provided at a lower end of the connection rib 100 in such a manner as to decrease in thickness toward a lower end portion. A connection hole 105 in which the connection rib 100 is to be latched is formed at an upper end of the release lever 104. A to-be-pressed portion 106, which protrudes in a direction orthogonal to a detaching direction along which a switch unit 60 is detached to/from the guide groove 64 and which also protrudes in the detaching direction, is provided at a lower end of the release lever 104. The to-be-pressed portion 106 protrudes downward from the guide groove 64. The to-be-pressed portion 106 inclines in such a manner as to decrease in thickness toward an upper end portion. As illustrated in FIG. 13A, the release lever 104 integrally combines with the guide groove 64 of the switch cover 61 via an elastic arm 109. The elastic arm 109 has an angle with respect to the guide groove 64, and extends upward between the connection hole 105 of the release lever 104 and the to-be-pressed portion 106.

Because other parts are the same as those of the first embodiment, identical portions are denoted by identical reference signals and detailed description thereof is not given.

Next, in order to connect the switch unit 60 to the operation unit 11, the release lever 104 of the switch unit 60 is positioned at the connection portion 46 of the screw-thread fitting unit 40 attached to the panel 15 and a distal end of the release lever 104 is brought into sliding contact with the guiding inclined surface 102. Next, the release lever 104 is inserted into the connection portion 46, so that the connection hole 105 passes over the connection rib 100 and is then latched in the engaging surface 101. As a result, the connection hole 105 and the connection rib 100 engage with each other, and attachment of the switch unit 60 to the operation unit 11 is completed.

Figure 13B:
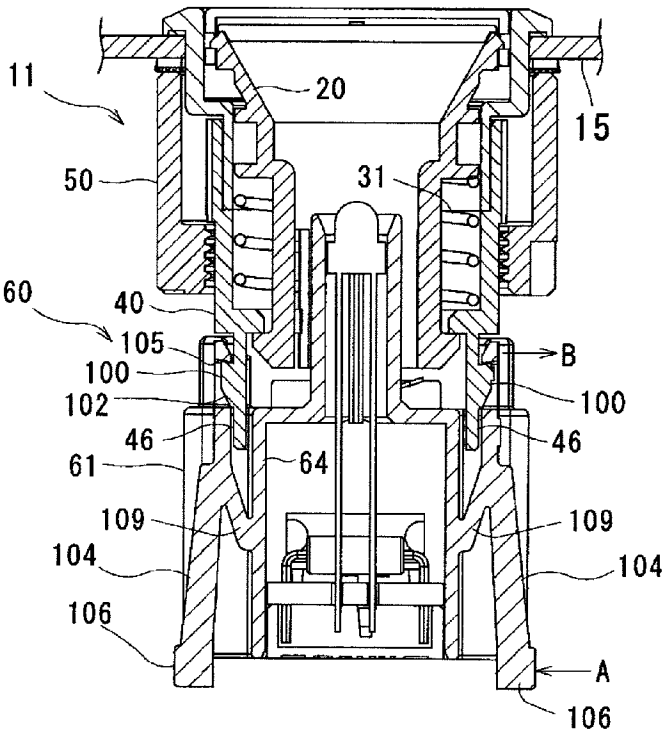
FIG. 13B is a sectional view in a state where the switch unit is mounted to the operation unit.
Figure 13A:
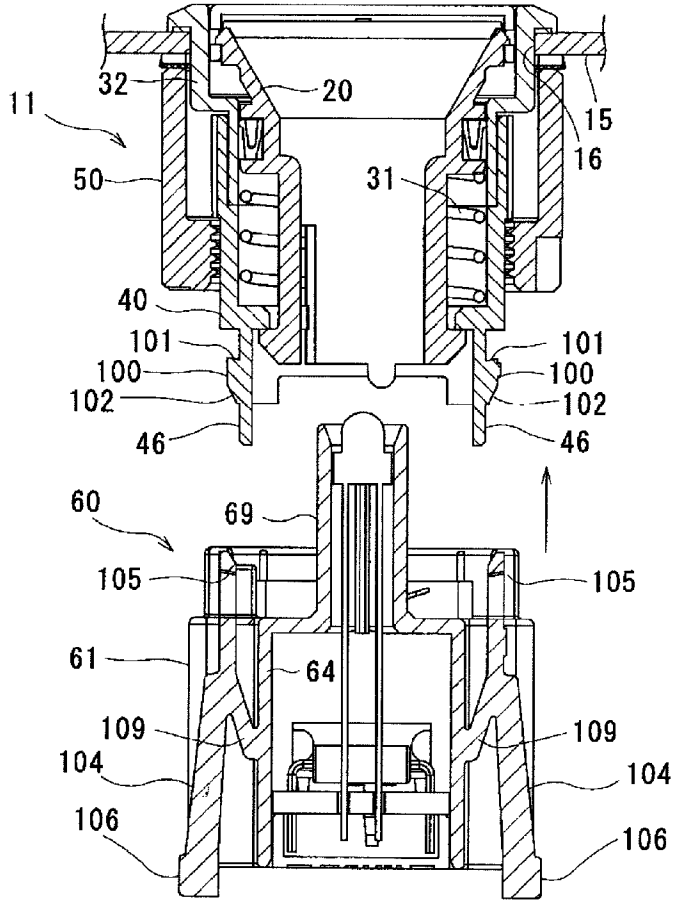
FIG. 13A is a sectional view illustrating a state where the operation unit and the switch unit are separated.
Figure 14:
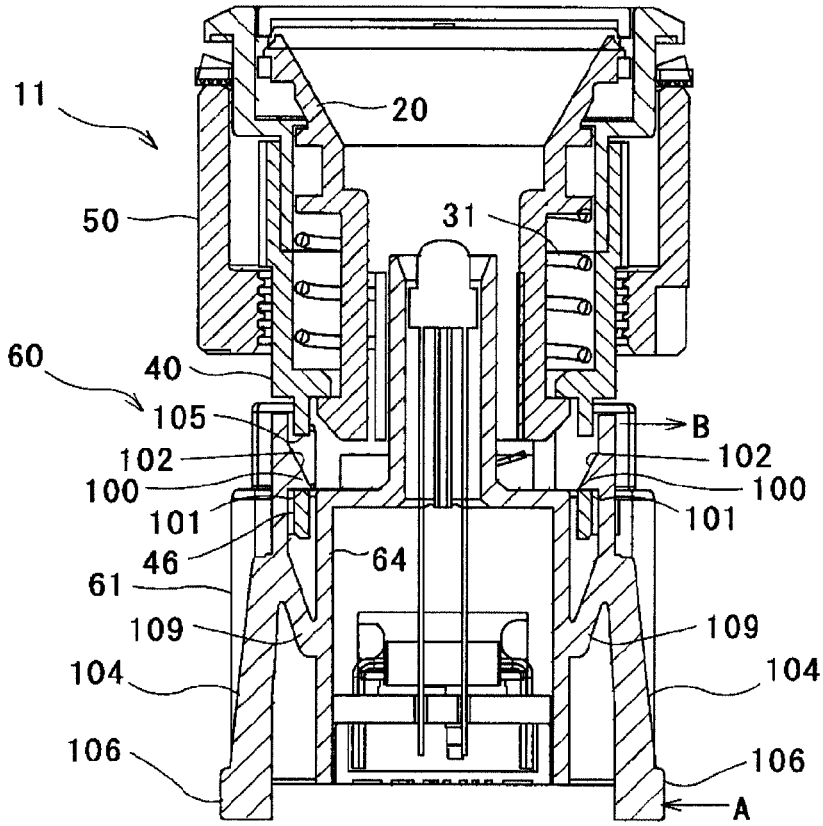
FIG. 14 is a sectional view according to a modification of the second embodiment.

In order to separate the switch unit 60 from the operation unit 11, as illustrated in FIG. 13B, the to-be-pressed portion 106 of the release lever 104 is pressed in the direction of arrow A. With this operation, the elastic arm 109 bends and the release lever 104 turns about a base portion of the elastic arm 109, so that the connection hole 105 moves outward as indicated by arrow B. Accordingly, the latching of the connection hole 105 and the connection rib 100 is released, and the switch unit 60 can be separated from the operation unit 11. As described above, even though the operation switches 10 are densely fitted in the panel 15, if there is space in a direction orthogonal to the detaching direction of the switch unit 60, the to-be-pressed portion 106 of the release lever 104 is pressed and the switch unit 60 can be separated from the operation unit 11. In addition, pressing force is more directly transferred to the connection hole 105 by pressing the to-be-pressed portion 106, and the connection hole 105 moves away from the connection portion 46 so that the latching of the operation unit 11 and the switch unit 60 can be surely released.

The present invention is not limited to the second embodiment, but various modifications thereof are possible.

In the above-mentioned embodiment, the connection rib 100 which protrudes outward is provided in the connection portion 46 of the screw-thread fitting unit 40, and the connection hole 105 is provided in the release lever 104. However, the invention is not limited thereto. For example, in a case where a connection hole 105 is provided in a connection portion 46 of a screw-thread portion 40 and a connection rib 100 which protrudes inward is provided in a release lever 104 like a modification illustrated in FIG. 14, the same advantage can be obtained.

Although the release lever according to the present invention protrudes in a detaching direction of the switch unit 60, and/or in a direction orthogonal to the detaching direction, a configuration, in which the release lever is provided in such a manner as not to protrude, may be adopted as long as it is possible to operate the switch unit 60 from an external end portion. In addition, in the embodiment, although a pair of connection portions 46, connection ribs 65, or connection holes 105 is provided, the invention is not limited thereto. At least one connection portion 46, connection rib 65, or connection hole 105 may be provided.

There has thus been shown and described an operation switch which fulfills all the objects and advantages sought therefore. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An operation switch comprising:

an operation unit disposed on a front surface side of a panel and operated by an external pressing force;

a switch unit having a first end configured to be attachable to and detachable from the operation unit from a rear surface side of the panel, said switch unit including a second end opposite said first end;

a latching unit formed on an external circumferential surface of the operation unit along an axial center direction;

a latching receiving unit which is formed along an external circumferential surface of the switch unit and to which the latching unit is latched;

a release lever that releases a latching state of the latching unit and the latching receiving unit so that the switch unit is separated from the operation unit, the release lever being configured to be operated from the second end of the switch unit; and a to-be-pressed portion accessible at a location furthest away from the first end, the to-be-pressed portion protruding from the second end of the switch unit, and configured to be pressable from said second end to operate said release lever to release said latching state, wherein the latching unit is formed of a connection portion with a hole, the latching receiving unit is formed of a rib that protrudes outward from the switch unit, and when an engaging surface of the rib is latched in the hole, the operation unit and the switch unit are latched to each other and a releasing surface presses and expands the connection portion.

2. The operation switch according to claim 1, wherein the release lever includes a to-be-pressed portion that is formed in a portion in such a manner as to protrude from the external end portion of the switch unit, the releasing surface is formed in another portion opposite to the to-be-pressed portion in such a manner as to engage with the latching unit, and an elastic arm is disposed between the to-be-pressed portion and the releasing surface to hold the release lever so that the release lever stays at the switch unit, and wherein when the to-be-pressed portion is pressed, the releasing surface turns about the elastic arm and the latching unit is displaced.

3. The operation switch according to claim 1, wherein the release lever integrally combines with the latching receiving unit, and includes the to-be-pressed portion that protrudes from an external form of the switch unit, the latching receiving unit formed on a portion opposite the to-be-pressed portion and configured to be latched to the latching unit, and an elastic arm that is disposed between the to-be-pressed portion and the latching receiving unit and that holds the release lever so as to stay at the switch unit, and when the to-be-pressed portion is pressed, the latching receiving unit turns about the elastic arm so as to be separated from the latching portion.

4. The operation switch according to claim 1, wherein the to-be-pressed portion protrudes from an end face of the switch unit in a detaching direction along which the switch unit is detached.

5. The operation switch according to claim 2, wherein the to-be-pressed portion protrudes from an end face of the switch unit in a detaching direction along which the switch unit is detached.

6. The operation switch according to claim 3, wherein the to-be-pressed portion protrudes from an end face of the switch unit in a detaching direction along which the switch unit is detached.

7. The operation switch of claim 1, wherein the to-be-pressed portion is located adjacent the second end of the switch unit.

8. An operation switch comprising:

an operation unit disposed on a front surface side of a panel and operated by an external pressing force;

a switch unit having a first end configured to be attachable to and detachable from the operation unit from a rear surface side of the panel, said switch unit including a second end opposite said first end;

a latching unit formed on an external circumferential surface of the operation unit along an axial center direction;

a latching receiving unit which is formed along an external circumferential surface of the switch unit and to which the latching unit is latched;

a release lever that releases a latching state of the latching unit and the latching receiving unit so that the switch unit is separated from the operation unit, the release lever being configured to be operated from the second end of the switch unit; and a to-be-pressed portion accessible at a location furthest away from the first end, the to-be-pressed portion protruding from the second end of the switch unit, and configured to be pressable from said second end to operate said release lever to release said latching state, wherein the latching unit is formed of a rib which protrudes inward from the operation unit, the latching receiving unit is formed of a hole, and when an engaging surface of the rib is latched in the hole, the operation unit and the switch unit are latched to each other and a releasing surface presses and expands the rib.

9. The operation switch according to claim 8, wherein the to-be-pressed portion protrudes from an end face of the switch unit in a detaching direction along which the switch unit is detached.

10. The operation switch according to claim 8, wherein the release lever integrally combines with the latching receiving unit, and includes the to-be-pressed portion that protrudes from an external form of the switch unit, the latching receiving unit formed on a portion opposite the to-be-pressed portion and configured to be latched to the latching unit, and an elastic arm that is disposed between the to-be-pressed portion and the latching receiving unit and that holds the release lever so as to stay at the switch unit, and when the to-be-pressed portion is pressed, the latching receiving unit turns about the elastic arm so as to be separated from the latching portion.

11. The operation switch according to claim 10, wherein the to-be-pressed portion protrudes from an end face of the switch unit in a detaching direction along which the switch unit is detached.

12. The operation switch of claim 8, wherein the to-be-pressed portion is located adjacent the second end of the switch unit.

* * * * *